US006895871B1

(12) United States Patent
Smith et al.

(10) Patent No.: US 6,895,871 B1
(45) Date of Patent: May 24, 2005

(54) HAZARDOUS MATERIALS DECONTAMINATION PLATFORM

(75) Inventors: William G. Smith, Martinsville, IN (US); Roger D. Enochs, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 84 days.

(21) Appl. No.: 10/342,659

(22) Filed: Jan. 15, 2003

(51) Int. Cl.[7] ..... A47B 3/00
(52) U.S. Cl. ..... 108/115; 108/57.32; 108/57.14
(58) Field of Search ..... 108/57.14, 57.32, 108/54.1, 56.1, 57.22, 57.31, 57.17, 51.11, 108/57.3, 131, 132, 129; 211/85, 126.6, 126.9, 211/132.1, 149, 195, 181.1, 153

(56) References Cited

U.S. PATENT DOCUMENTS 1,700,843 A * 2/1929 Hayward ..... 108/56.1
1,918,003 A * 7/1933 Taylor et al. ..... 108/56.1
2,204,446 A * 6/1940 Robinson ..... 108/161
2,565,292 A * 8/1951 Arthur ..... 105/375
4,244,768 A 1/1981 Wiechowski et al.
4,297,953 A * 11/1981 Shy ..... 108/131
4,501,402 A * 2/1985 Saito et al. ..... 248/346.02
4,675,923 A 6/1987 Ashley
4,838,178 A 6/1989 Chriske et al.
4,858,256 A 8/1989 Shankman
4,890,343 A 1/1990 Schlags
4,934,396 A 6/1990 Vitta
4,953,473 A * 9/1990 Tomaka et al. ..... 108/132
5,020,667 A 6/1991 Bush
5,562,047 A * 10/1996 Forney et al. ..... 108/57.13
5,687,652 A 11/1997 Ruma
5,802,986 A 9/1998 Lin
5,906,165 A * 5/1999 McCorkle et al. ..... 108/55.1
6,101,768 A 8/2000 Springstead et al.
6,105,512 A 8/2000 Lin
6,164,298 A 12/2000 Petter et al.
6,382,108 B1 * 5/2002 Stanek et al. ..... 108/55.1
6,561,107 B1 * 5/2003 Wood et al. ..... 108/132

FOREIGN PATENT DOCUMENTS

FR 2557934 * 1/1984

* cited by examiner

*Primary Examiner*—Jose V. Chen
(74) *Attorney, Agent, or Firm*—Fredric Zimmerman

(57) ABSTRACT

A portable, re-usable, elevated platform that provides a large, non-slip, grated surface on which an individual wearing a fully-encapsulated, hazardous materials suit may stand, and turn as needed to ensure thorough on-site decontamination. The platform generally comprises a top grate and two folding/pivoting support leg assemblies. The elevated design of the platform allows for the collection of the hazardous material runoff in a containment vessel deployed underneath. The platform is fabricated of impervious, strong, lightweight materials to prevent absorption of any hazardous materials and to provide sufficient structural strength while keeping its overall weight reasonable. The design is simple and straightforward, and can be economically manufactured.

12 Claims, 5 Drawing Sheets

HAZARDOUS MATERIALS DECONTAMINATION PLATFORM

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention relates to devices which facilitate hazardous materials decontamination procedures and, more particularly, to a portable, durable, re-usable platform for use in the performance of said decontamination procedures.

2. Description of the Background

Hazardous materials response personnel ("responders"), such as firefighters, are typically subjected to some form of on-site decontamination procedure once the circumstances requiring their presence have been addressed. Often, one or more fully-encapsulated hazardous material suits must be deployed to ensure the safety of the responders while working with, or in the vicinity of, the hazardous material(s). Use of one or more of those suits requires that they be subjected to thorough decontamination prior to storage for future use. One procedure for accomplishing the required on-site decontamination is the washing of the suit's exterior with an appropriate cleaning/decontamination agent while being worn by the responder. However, due to the presence of hazardous materials in the fluid runoff, the procedure must include the collection of that contaminated runoff in some form of temporarily deployed vessel.

Previously, responders grabbed any convenient implement to elevate themselves above the collection vessel (and accumulated fluid), inclusive of plastic or metal, "milk"-style crates and plastic pallets. Unfortunately, these unintended devices raise safety issues such as: (1) insufficient structural strength to support the combined weight of the responder and the hazardous materials suit, (2) insufficient lateral stability while the responder is stepping on or off the apparatus, and (3) insufficient physical size (i.e. length, width). When a responder is wearing a fully-encapsulated hazardous materials suit, his/her vision and dexterity are severely compromised. If a responder trips and/or falls while attempting to step on or off the elevated apparatus, needless injury to or direct contamination of his/her body, and damage or destruction of the hazardous materials suit, can result.

The present invention is not the first to address the need for elevated support platforms used in association with the clean up and/or containment of hazardous materials. For example, U.S. Pat. Nos. 4,838,178 to Chriske et al., 5,020,667 to Bush, and 6,382,108 to Stanek et al. disclose platforms designed to accommodate hazardous materials. Each of the platforms has a perforated top surface and an integral containment vessel. Additional devices intended to facilitate cleaning and/or decontamination procedures are found in U.S. Pat. Nos. 4,675,923 to Ashley, 4,858,256 to Shankman, and 6,164,298 to Petter et al. Each of those apparatus include a platform on which an individual may stand, or an object may be situated, such that a cleaning/decontamination procedure may be completed.

Unfortunately, each of these prior art devices possesses certain limitations with respect to the specific needs addressed by the present invention. The Chriske et al., Bush, and Stanek et al. devices do not incorporate collapsible and weight-minimizing designs to emphasize ease of storage and portability. They are each, in fact, intended primarily for transportation via fork-lift trucks. The platforms of the Ashley, Shankman, and Petter et al. apparatus are piecemeal components of far more elaborate systems and are likewise not at all portable.

Therefore, there remains a need for a portable apparatus that provides a substantial degree of utility in supporting the weight of a responder wearing a fully-encapsulated hazardous materials suit in an elevated position during on-site decontamination procedures. An apparatus of this type should be sized to provide a responder, even with the limited vision/dexterity imposed by the hazardous materials suit, with a large enough area to safely maneuver during decontamination, collapsible to allow for easy storage and transportation, lightweight for optimum portability, and economical to manufacture in order to provide for widespread use.

SUMMARY OF THE INVENTION

It is, therefore, the primary object of the present invention to provide an improved apparatus for supporting hazardous materials response personnel in an elevated position during on-site decontamination procedures.

It is another object of the present invention to provide an improved elevated platform for use during on-site decontamination procedures that prevents damage to the temporarily deployed hazardous material containment vessel.

It is still another object of the present invention to provide an improved elevated platform for use during on-site decontamination procedures that is collapsible for storage and transport.

Yet another object of the present invention is to provide an improved elevated platform for use during on-site decontamination procedures with folding leg assemblies that also serve as handles for transportation.

It is another object of the present invention to provide an improved elevated platform for use during on-site decontamination procedures that is lightweight for portability.

Still another object of the present invention is to provide an improved elevated platform for use during on-site decontamination procedures that is economical to manufacture to provide for widespread use.

These and other objects are accomplished by a portable, re-usable, elevated platform that provides a large, non-slip, grated surface on which an individual wearing a fully-encapsulated, hazardous materials suit may stand, and turn as needed, to ensure thorough on-site decontamination. The present invention generally comprises a top grate and two folding/pivoting support leg assemblies with locking pins. The elevated design allows for the collection of the hazardous material runoff in a containment vessel deployed underneath. The present invention is fabricated of impervious, strong, lightweight materials (e.g. aluminum) to prevent absorption of any hazardous materials and to provide sufficient structural strength while keeping its overall weight reasonable (i.e. to be transported/set-up by a single individual). Moreover, the closed-cell design of the present device prevents any accumulation of chemicals which might otherwise pose a hazard. All chemicals run through for collection in a basin. The present invention's design is simple and straightforward, and can be economically manufactured.

The support leg assemblies are pivotally mounted at each end of the frame and fold inward, and lock in position, for storing or transporting the platform. Upon folding outward, locking pins hold the legs in position substantially perpendicular to the top grate. The ends of the leg assemblies are sealed to prevent the retention/cross-contamination of any hazardous materials and turned slightly upward at the ends to prevent damage to the containment vessel.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
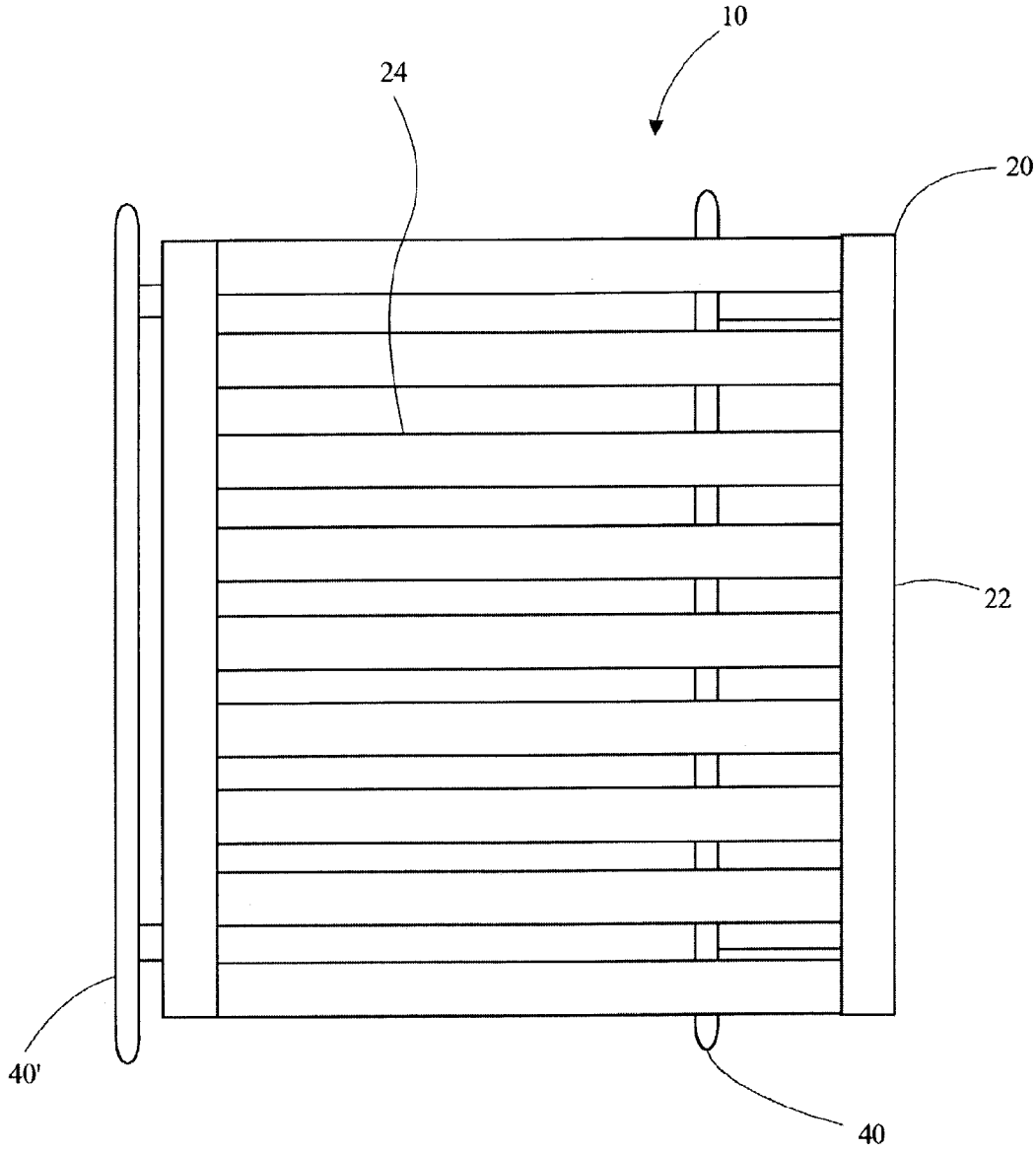
FIG. 1 is a top perspective view of a decontamination platform 10 according to a first embodiment of the present invention.
Figure 2:
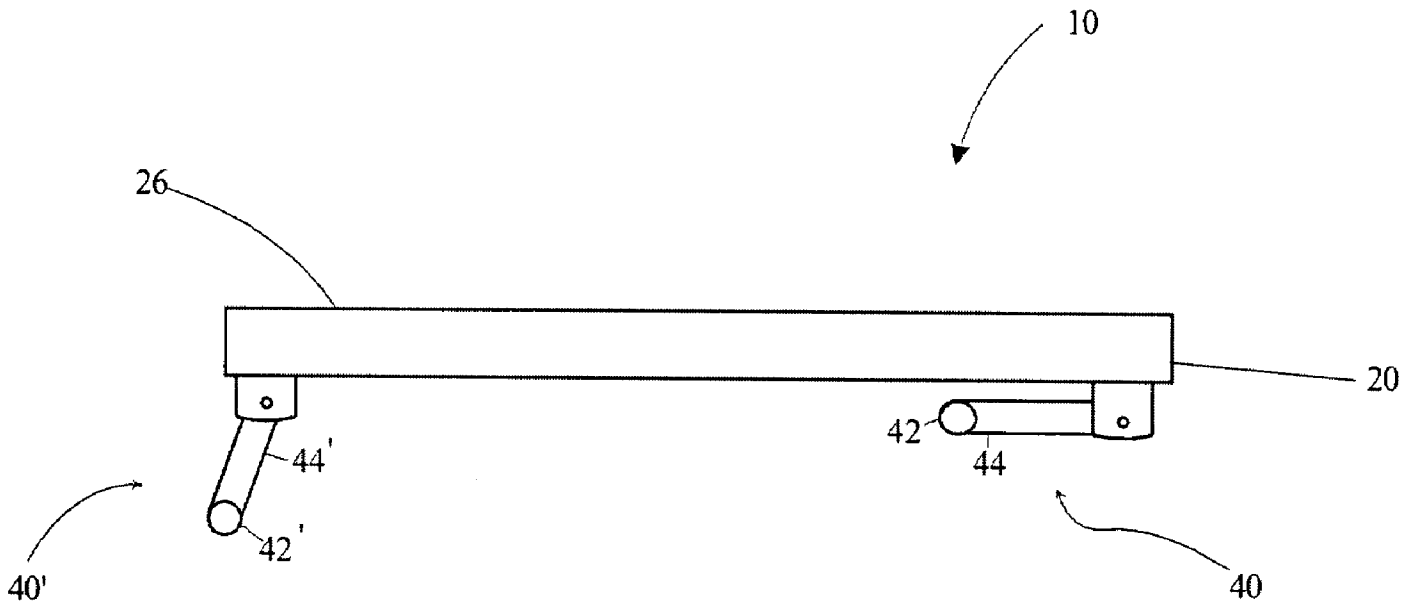
FIG. 2 is a side perspective view of the decontamination platform 10 as in FIG. 1 showing one leg assembly 40 in the folded position and a second leg assembly 40' in the extended position.
Figure 3:
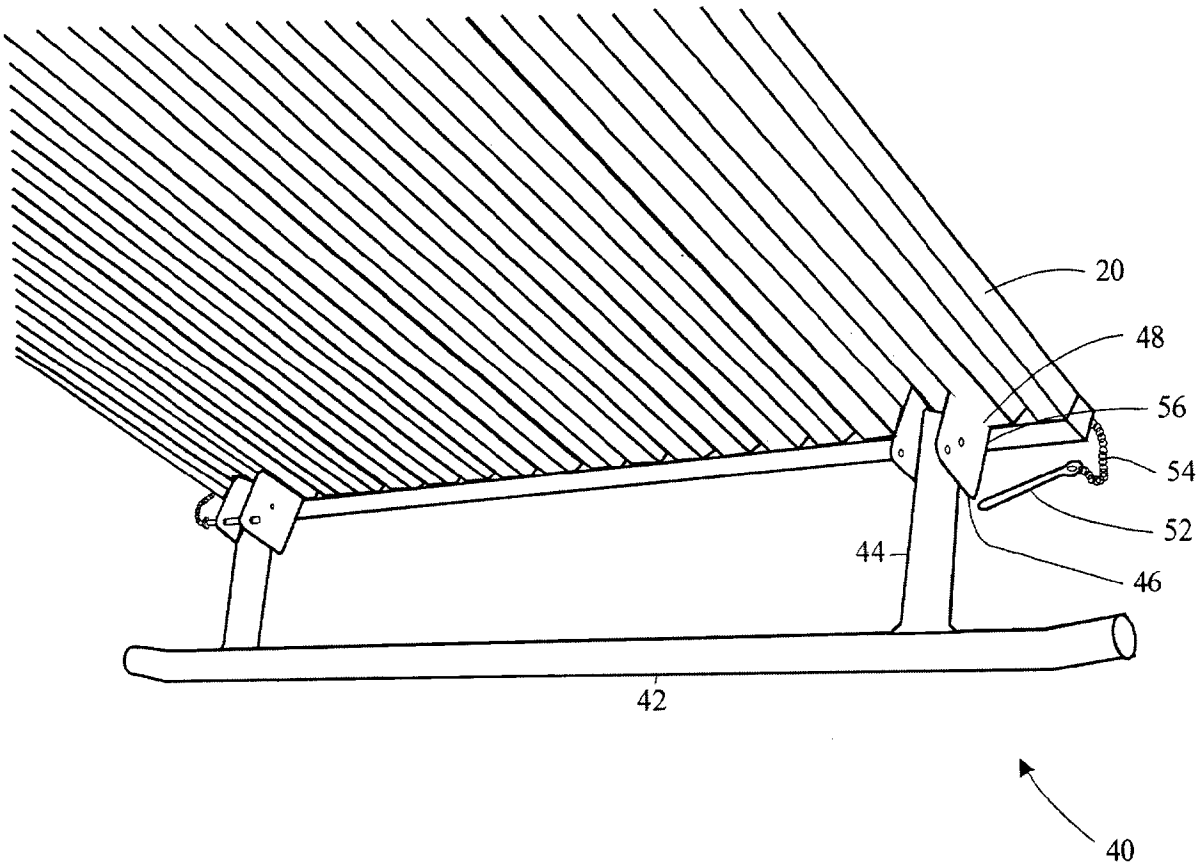
FIG. 3 is a partial bottom perspective view of the decontamination platform 10 as in FIGS. 1 and 2, showing a leg assembly 40'.

FIGS. 1–3 are, respectively, top, side, and partial bottom perspective views of a decontamination platform 10 according to a preferred embodiment of the present invention. The decontamination platform 10 generally comprises a top grate 20 and two folding/pivoting support leg assemblies 40, 40'.

The top grate 20 typically includes two end members 22 and a plurality of cross members 24. The end members 22 and cross members 24 are preferably fabricated of commercially available aluminum solid bar or tubular stock having a rectangular cross-section. The end members 22 are sealed with aluminum plugs to prevent ingress and collection of hazardous materials. Each end of a cross member 24 is fixedly attached to one of the end members 22. The cross members 24 are preferably attached by welding to the end members 22, and a full butt weld is preferred to seal the hollow interior of the cross members 24. The net result, as shown in FIG. 1, is a substantially square assembly with a flat platform top and a series of equal gaps between the cross members 24.

Tape 26 possessing a high coefficient of friction on its exposed surface is adhesively attached to the top surfaces of the end and cross members 22, 24, respectively.

In the illustrated embodiment the top grate 20 measures approximately 48" along each side, thereby providing a 16 square foot surface on which a responder may stand while being decontaminated, with equal gaps of 1.5" to 2.5" between the cross members to provide adequate drainage. Alternative embodiments of the present invention may include top grates 20 that vary in size and are fabricated of materials other than aluminum. It should also be understood that alternative embodiments may include gaps between the cross members 24 that measure more or less than 1.5" to 2.5".

Figure 4:
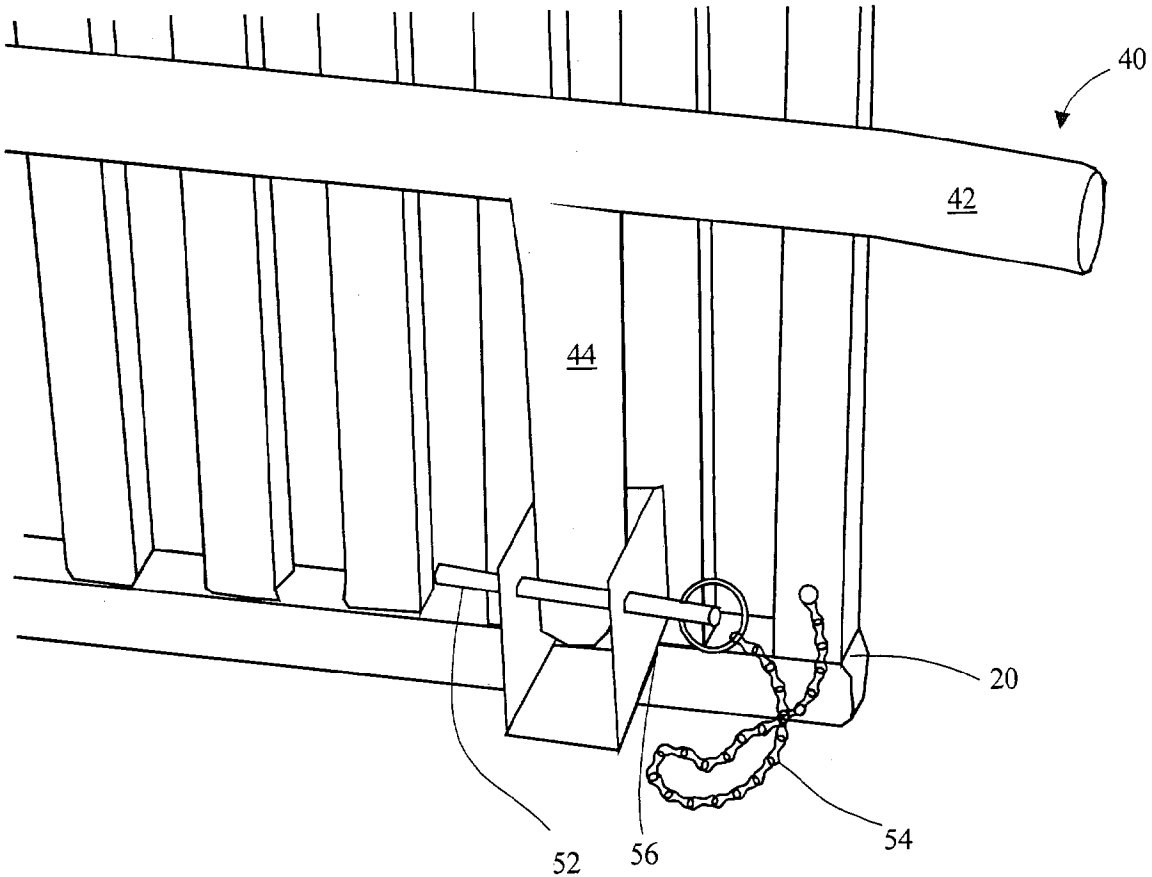
FIG. 4 is a close up view of a leg assembly 40.

FIG. 4 is a close up view of a leg assembly 40, according to a first embodiment of the present invention, shown in the folded position. Two leg assemblies 40, 40' are pivotally mounted to the top grate 20 proximate points where the cross members 24 are fixedly connected to the end members 22. Each of the leg assemblies 40, 40' preferably includes a foot/crossbar 42, two support members 44, two mounting brackets 46, two commercially available pivot pins 48, two commercially available spring-loaded quick-release pins 52, and two commercially available pin retention chains 54. The foot/crossbar 42, two support members 44, and two mounting brackets 46 are preferably fabricated of commercially available aluminum solid round or tubular stock. As above all open ends of the tubular stock are sealed with aluminum plugs to prevent ingress and collection of hazardous materials. Alternative embodiments of the present invention may include feet/crossbars 42, support members 44, and mounting brackets 46 that are fabricated of materials other than aluminum. Alternative embodiments may also include more than two support members 44 and more than two mounting brackets 46 per leg assembly.

The leg assemblies 40, 40' are constructed as follows. One end of each of the support members 44 is fixedly attached perpendicularly to a foot/crossbar 42. The opposite end of each of the support members 44 is pivotally attached to a mounting bracket 46 via a pivot pin 48. The mounting brackets 46 are fixedly attached to the top grate 20 proximate points where the cross members 24 are fixedly connected to the end members 22. The linear spacing of the support members 44, as attached to the foot/crossbar 42, is preferably equivalent to that of the mounting brackets 46, as attached to the top grate 20. Both ends of each foot/crossbar 42 are bent slightly in the direction of the support members 44 such that when the leg assemblies 40, 40' are extended and the platform 10 is resting on a surface, the ends of the feet/crossbars 42 are angled slightly away from that surface.

The retention chains 54 are used to establish a permanent, yet flexible, connection between the quick-release pins 52 and the top grate 20. In this manner, the pins 52 are not subject to being misplaced/lost during the platform 10 set up, or tear down, process described in detail below. The quick-release pins 52 are inserted in through holes 56, and are thereby releasably attached to the mounting bracket 46, to hold the leg assemblies 40, 40' in either the folded or extended position.

The leg assemblies 40, 40' fold inward (i.e. toward the top grate 20) for storing or transporting the platform 10. Upon folding outward, the quick-release pins 52 hold the leg assemblies 40, 40' in position substantially perpendicular to the top grate 20. The leg assemblies 40, 40' pivot about pins 48 that extend through the mounting brackets 46 and the support members 44.

With collective reference to FIGS. 1–4, the set up process for the decontamination platform 10, from its fully collapsed configuration for storage or transportation, begins with the extension of the leg assemblies 40, 40'. This is accomplished by first placing the collapsed platform 10 upside down on the ground or floor (i.e. essentially resting on the tape 26 affixed to the top grate 20). Each leg assembly 40, 40' is extended by removing the quick-release pins 52 from the holes 56, grasping the foot/crossbar 42 and pulling. As the foot/crossbar 42 moves away from the top grate 20, the support members 44 rotate around the pivot pins 48. Once the support members 44 reach a position that is substantially perpendicular to the top grate 20, the leg assembly 40' is locked in the extended position by replacing the quick-release pins 52 in the holes 56 located in the mounting brackets 46.

Once both leg assemblies 40, 40' have been extended and locked in place, the platform 10 may be turned over and set upon the ground or floor (i.e. resting in a stable configuration on feet/crossbars 42). The total time required to set up the platform, from its fully collapsed state, is approximately one minute. As noted above, the ends of the feet/crossbars 42 are angled slightly away from the ground or floor. In this manner, the probability of damaging or puncturing the hazardous materials collection vessel 60 (see FIG. 5), on which the platform 10 is typically positioned, is minimized, if not eliminated.

To fold the present invention into its fully collapsed configuration for storage or transportation, the platform 10 is first placed upside down on the ground or floor (i.e. again resting on the tape 26 affixed to the top grate 20). Each of the leg assemblies 40, 40' is collapsed by removing the quick-release pins 52 from the holes 56 and pushing the foot/crossbar 42 toward the top grate 20. This causes the support members 44 to rotate around the pivot pins 48. Once the support members 44 reach a position that is substantially parallel to the top grate 20, the leg assembly 40 is locked in the folded position by replacing the quick-release pins 52 in the holes 56 located in the mounting brackets 46. Due to the extension of the feet/crossbars 42 beyond the edges of the top grate 20, the legs assemblies 40, 40', when locked in the folded or collapsed position, also serve as handles to assist in the transportation of the decontamination platform 10 by one or two individuals.

Figure 5:
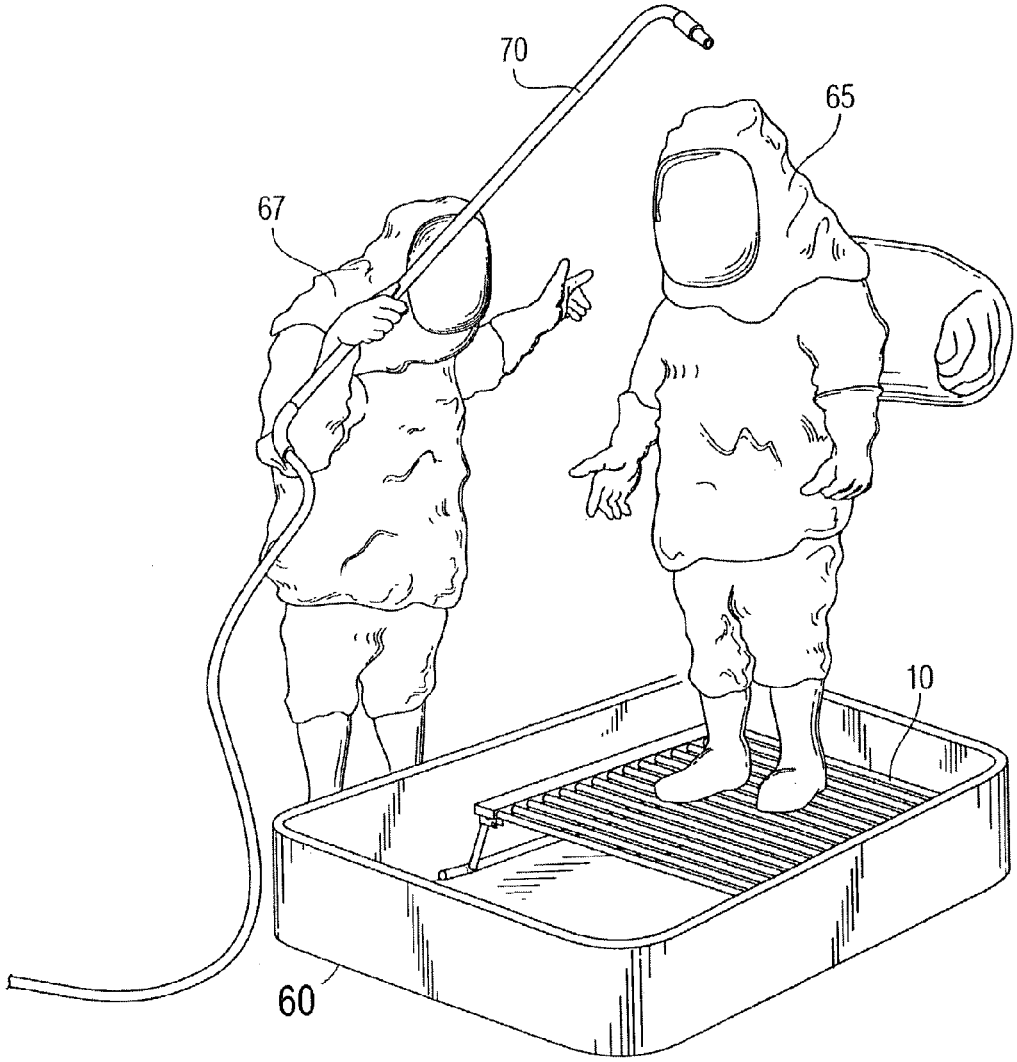
FIG. 5 is a perspective view of the decontamination platform 10 shown in use during a hazardous materials decontamination procedure.

When used as intended and as shown in FIG. 5, the platform 10, with its leg assemblies 40, 40' extended, is placed proximate the center of a hazardous materials collection vessel 60. A responder 65 wearing a fully encapsulated hazardous materials suit steps onto the platform 10, thereby placing himself/herself in an elevated position over the containment vessel 60. A second responder 67 may then thoroughly decontaminate the exterior surface of the hazardous materials suit worn by the first responder 65 by applying an appropriate liquid via a nozzle assembly 70. The liquid dripping off of the hazardous materials suit falls through the top grate 20 of the platform 10 and collects in the containment vessel 60 for proper disposal.

As is readily perceived in the foregoing description, the portable, re-usable, elevated platform 10 of the present invention provides a large, non-slip, grated surface 20 on which an individual 65 wearing a fully-encapsulated, hazardous materials suit may stand, extend his/her arms, and turn as needed, to ensure thorough on-site decontamination. The platform 10 may even be utilized to decontaminate an individual that has been injured and is lying on an emergency medical service "spine board". The elevated design of the present invention allows for the collection of the hazardous material runoff in a containment vessel 60 deployed underneath. The collapsible nature of its design provides for easy storage and manual transportation. The design of the feet/crossbars 42 reduces the probability of damage to the containment vessel 60 and assists in the transportation of the platform 10. The present invention is fabricated of impervious, strong, lightweight materials (e.g. aluminum) to prevent absorption of any hazardous materials, and the tubular construction provides sufficient structural strength (i.e. to support up to 600 lbs.) while keeping the overall weight reasonable (i.e. to be transported/set-up by a single individual). The present invention's design is simple and straightforward, and can be economically manufactured.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A decontamination platform for elevating a responder, having weight, above a fluid collection vessel, comprising:

a top grate; and two leg assemblies pivotally attached to said top grate, each of said leg assemblies comprising:

a pair of support members each pivotally attached proximate a corner of said top grate;

a pair of locking hinges mounted on said top grate for pivotally attaching said pair of support members and for selectively locking them in position;

a crossbar integrally joining the pair of support members and having curved-in ends, whereby when said leg assembly is pivoted downward at the support members the crossbar serves to distribute the weight and the curved-in ends avoid damage to the collection vessel; and wherein said ends of said crossbars of said leg assemblies extend beyond edges of said top grate, thereby serving as handles for transporting said decontamination platform.

2. The decontamination platform according to claim 1 wherein said top grate further comprises:

at least two end members; and a plurality of cross members fixedly attached to said end members.

3. The decontamination platform according to claim 2 wherein said plurality of cross members are fixedly attached to said end members such that gaps of 1.5" to 2.5" exist between said cross members to provide adequate drainage through said top grate.

4. The decontamination platform according to claim 2 wherein said end members and said plurality of cross members are fabricated of solid bar stock to prevent ingress and collection of hazardous materials.

5. The decontamination platform according to claim 2 wherein said end members and said plurality of cross members are fabricated of tubular stock with all open ends being sealed to prevent ingress and collection of hazardous materials.

6. The decontamination platform according to claim 1 wherein said top grate further comprises adhesively attached tape, said tape possessing a high coefficient of friction on its exposed surface.

7. The decontamination platform according to claim 1 wherein said top grate is fabricated of aluminum.

8. The decontamination platform according to claim 1 wherein said leg assemblies further comprise locking means for maintaining said leg assemblies in either a folded or an extended position.

9. The decontamination platform according to claim 8 wherein said locking means further comprise a spring-loaded quick-release pin installed in a through hole.

10. The decontamination platform according to claim 1 wherein said support members and said feet/crossbars of said leg assemblies are fabricated of solid bar stock to prevent ingress and collection of hazardous materials.

11. The decontamination platform according to claim 1 wherein said support members and said feet/crossbars of said leg assemblies are fabricated of tubular stock with all open ends being sealed to prevent ingress and collection of hazardous materials.

12. The decontamination platform according to claim 1 wherein said support members and said feet/crossbars, of said leg assemblies are fabricated of aluminum.

* * * * *